US007229526B2

(12) United States Patent
Obitz

(10) Patent No.: US 7,229,526 B2
(45) Date of Patent: Jun. 12, 2007

(54) METHOD AND APPARATUS FOR THE FEEDING OF FIBERS

(76) Inventor: Lars Obitz, Isterberget 3, SE-185 00, Vaxholm (SE)

( * ) Notice: Subject to any disclaimer, the term of this patent is extended or adjusted under 35 U.S.C. 154(b) by 590 days.

(21) Appl. No.: 10/474,127

(22) PCT Filed: Apr. 10, 2002

(86) PCT No.: PCT/SE02/00711

§ 371 (c)(1),
(2), (4) Date: Oct. 6, 2003

(87) PCT Pub. No.: WO02/084019

PCT Pub. Date: Oct. 24, 2002

(65) Prior Publication Data

US 2004/0104002 A1 Jun. 3, 2004

(30) Foreign Application Priority Data

Apr. 17, 2001 (SE) ..... 0101349

(51) Int. Cl.

| | |
|---|---|
| ***D21B 1/12*** | (2006.01) |
| ***D21C 11/06*** | (2006.01) |
| ***D21C 1/10*** | (2006.01) |
| ***D21C 7/06*** | (2006.01) |
| ***D21C 7/08*** | (2006.01) |
| ***D21C 7/12*** | (2006.01) |
| ***D21F 5/00*** | (2006.01) |

(52) U.S. Cl. ..... 162/52; 162/47; 162/61; 162/68; 162/246; 162/252; 162/259

(58) Field of Classification Search ..... 162/52, 162/55, 68, 17, 19, 246, 239, 251, 47, 252, 162/61; 415/169.1, 169.2, 169; 222/368; 209/270, 284

See application file for complete search history.

(56) References Cited

U.S. PATENT DOCUMENTS 3,681,192 A * 8/1972 Reinhall ..... 162/246

(Continued)

FOREIGN PATENT DOCUMENTS

DE 19910530 A1 * 9/2000

(Continued)

*Primary Examiner*—José A. Fortuna
(74) *Attorney, Agent, or Firm*—Dowell & Dowell, P.C.

(57) ABSTRACT

A system for feeding fibres from a fibre separation step at a first pressure to a drying step at a second, lower pressure, the system comprising a sluice feeder (3) provided between the fibre separation step and the drying step. At least an outlet (14) of the sluice feeder (3) is enclosed by a housing (4) for pressurization by means of a pressure medium in the housing (4) to a pressure that essentially corresponds to the first pressure in the sluice feeder (3). The fed out fibre from the sluice feeder (3) to the housing (4) are removable by means of the pressure medium in the housing (4) via a control valve (20), which regulates the pressure in the housing (4), to the drying step at the second, lower pressure. The pressurization in the housing (4) prevents steam to escape from the sluice feeder (3). A method for feeding fibres, the fibres are fed to a sluice feeder (3) which is pressurized from the outside by means of a pressure medium and are fed out by means of the pressure medium via a pressure regulating control valve (20) to the drying step.

19 Claims, 2 Drawing Sheets

U.S. PATENT DOCUMENTS

Figure 1:
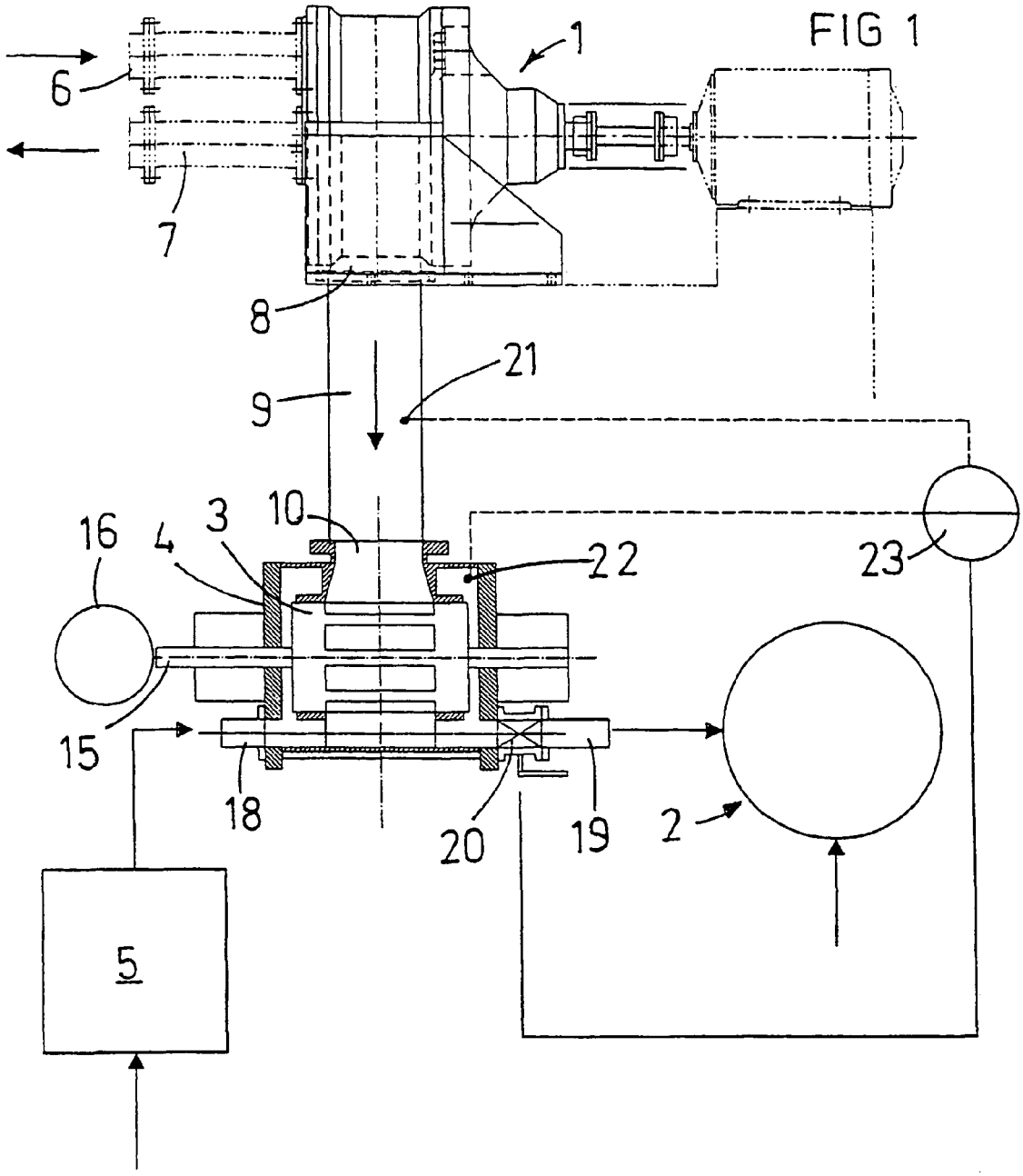

| | | | | |
|---|---|---|---|---|
| 4,072,274 | A * | 2/1978 | Syrjanen | 241/28 |
| 4,129,263 | A * | 12/1978 | Sjobom | 241/248 |
| 5,207,870 | A * | 5/1993 | Aho et al. | 162/53 |
| 5,672,245 | A * | 9/1997 | Andtbacka et al. | 162/17 |
| 6,024,837 | A * | 2/2000 | Laakso et al. | 162/237 |
| 6,109,450 | A * | 8/2000 | Grunenwald et al. | 209/270 |
| 6,214,171 | B1 * | 4/2001 | Snekkenes | 162/245 |
| 6,361,649 | B1 * | 3/2002 | Snekkenes | 162/17 |
| 2001/0000588 | A1 * | 5/2001 | Snekkenes | 162/237 |
| 2004/0104002 | A1 * | 6/2004 | Obitz | 162/52 |
| 2005/0189082 | A1 * | 9/2005 | Obitz | 162/52 |
| 2006/0037723 | A1 * | 2/2006 | Gustavsson et al. | 162/52 |

FOREIGN PATENT DOCUMENTS

| | | | |
|---|---|---|---|
| SE | 420226 | B | 9/1981 |
| SE | 437680 | B | 3/1985 |
| WO | WO 200284019 | A1 * | 10/2002 |
| WO | WO 2003074779 | A1 * | 9/2003 |
| WO | WO 2004079086 | A1 * | 9/2004 |
| WO | WO 2005064078 | A1 * | 7/2005 |

* cited by examiner 1
6
7
8
9
21
10
3
4
16
22
23
15
18
20
19
2
5

METHOD AND APPARATUS FOR THE FEEDING OF FIBERS

The present invention relates to a system for preparation of wood fibres for feeding fibres from a fibre separation step at a first pressure to a drying step at a second, lower pressure, whereby the system comprises a sluice feeder provided between the fibre separation step and the drying step and a method for production of wood fibres for feeding fibres.

TECHNICAL BACKGROUND

When preparing wood fibres a separation of fibres from steam takes place in a fibre separation step where a cyclone or a centrifugal separator is used for this purpose. Preferably, the steam is recycled also from this step. The pressure in the system before the fibre separation is in most cases about 3–12 bar. The following process step is the drying of the fibre. This takes place at a lower pressure, sometimes as low as atmospheric pressure. In order to prevent the steam from escaping to the drying step at lower pressure a pressure tight feeding of the fibre from the separation step is required.

When treating mechanical pulp for paper manufacturing, this can easily be solved by a plug screw where the fed fibres are compressed and form a steam tight plug in the plug screw at the same time as it is further fed and subsequently may be fed to further treatment at a lower pressure.

On the contrary, when treating mechanical pulp for manufacturing of, for example, fibre board or MDF-technology, it is not possible to compress the fibres since lumps thus are formed, which cause problems at the drying of the fibre and at following manufacturing of end products. Instead a sluice feeder may be used in which the separated fibre fall down into a pocket in its rotor provided in the sluice feeder, which rotor is rotated and the fibre falls out in the lower portion of the sluice feeder where a lower pressure prevails without being compressed. The rotor and its pockets are sealed against the periphery of the sluice feeder.

A problem however is that steam escapes from the sluice feeder despite efforts to seal sluice feeders. Due to the design of the rotor with pockets it is complicated to achieve desired tightness and thus expensive. The annual costs for energy losses are great.

SUMMARY OF THE INVENTION

To solve the problems associated with the prior art, the present invention is directed to a system and method for feeding fibers from a fiber separation step at a first pressure to a drying step at a second, lower pressure essentially without energy losses. Specifically, the present system provides a sluice feeder placed between a steam separator and a drying duct. The sluice feeder includes an inlet for receiving fibers from the steam separator and at least one outlet that is enclosed by a housing. The sluice feeder further includes means for pressurizing the housing a control valve that regulates the pressure in the housing. Accordingly, the present system allows fibers to be fed from the steam separator through the sluice feeder and then to the dryer by adjusting the pressure regulating valve to create a third pressure in the housing of the sluice feeder. As a result, allows fibers to move through the sluice feeder without steam escaping from the feeder.

Thanks to the housing arranged at least partly around the sluice feeder, at its outlet, a pressure may be provided around the sluice feeder or at least around its outlet that counteracts the pressure of the steam, whereby the steam will not escape into the housing. The transition between the first pressure and the second, lower pressure has been moved from a position between the inlet and the outlet of the sluice feeder to a position between the housing of the sluice feeder and the outlet from the housing. Preferably, the housing encloses the sluice feeder totally. This also results in the advantage that the housing only needs to be sealed against the surrounding atmospheric pressure at the shaft driving the rotor of the sluice feeder. Such pressure tight circular seals are available for a reasonable price having av very high tightness.

Preferably a compressor is comprised in the system, which compress a pressure medium, for example air, and conveys the compressed pressure medium into the housing. At the compression of the pressure medium the temperature rises of the pressure medium, which temperature rise is utilized at the following drying step, i.e. the energy consumed for compressing the pressure medium is transferred to heat energy in the pressure medium, which in turn is utilized for drying the fibres. In this way the costs for energy do not increase. The drying device uses preferably hot air for the drying of the fibres.

The fibres are separated from steam at the previous process step and this is preferably done by means of a centrifugal separator, which also ought to be equipped in such a way that it can utilize the steam and be followed by process step for recycling the energy content of the steam.

In order to easily regulate the pressure in the housing by means of a control valve a first sensor is arranged to sense the pressure before and in the sluice feeder, for example at the inlet to the sluice feeder, and a second sensor is arranged to sense the pressure in the housing. If automatic regulating is desired control means may be provided in the system which compare the pressure before and in the sluice feeder with the pressure in the housing and which controls the control valve depending on the result of the comparison.

SHORT DESCRIPTION OF THE DRAWINGS

Figure 3:
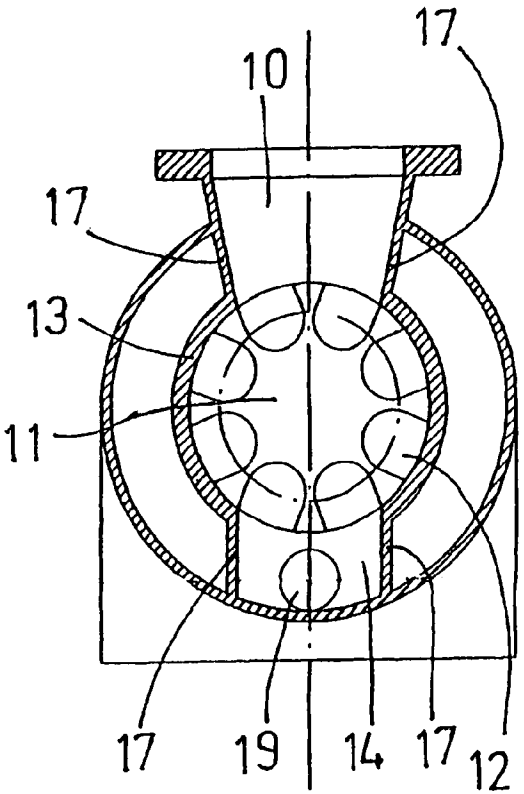
Figure 2:
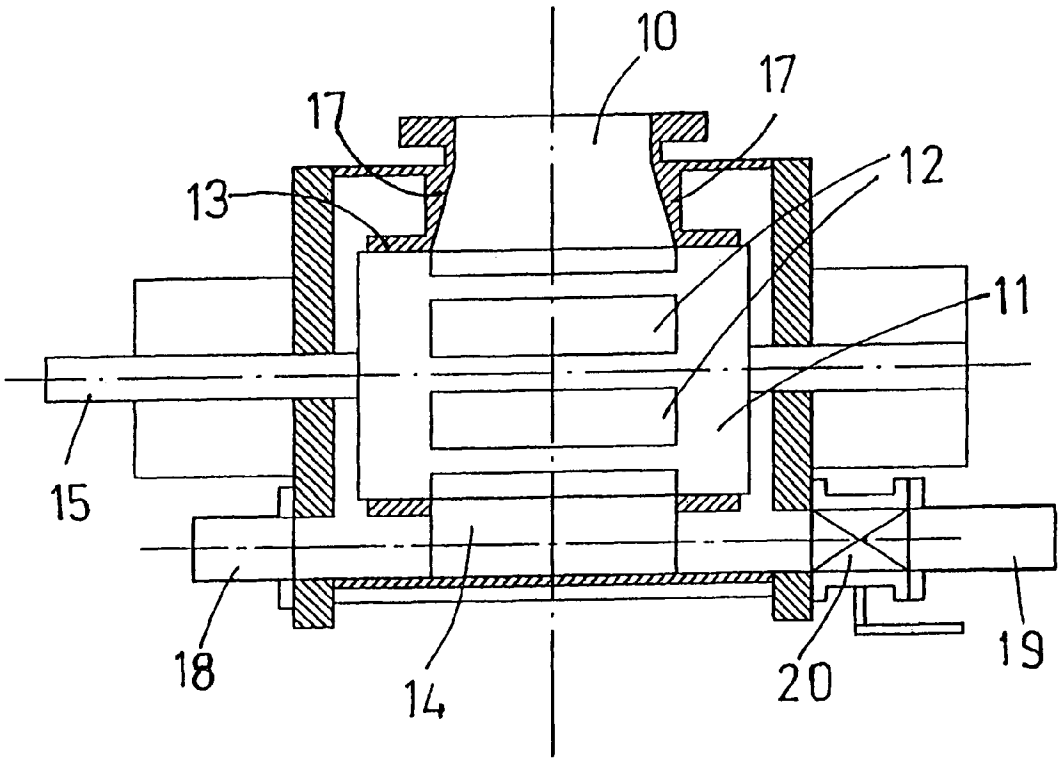

The invention will now be described in an exemplifying manner and referring to enclosed drawings, in which:

FIG. 1 illustrates a system of the present invention comprising a sluice feeder positioned in the process between a fibre separation step and a drying step, FIG. 2 illustrates a front view of a sluice feeder of the present invention, FIG. 3 illustrates a side view of the sluice feeder in FIG. 2.

DETAILED DESCRIPTION OF PREFERRED EMBODIMENTS

In FIG. 1 a fibre separation step is illustrated by a centrifugal separator 1 and a following drying step by a drying duct 2. Therebetween the system according to the present invention can be found, which in this embodiment comprises a sluice feeder 3 surrounded by a housing 4 and a compressor 5 which feeds compressed pressure medium to the housing 4. The housing may also if desired only cover the outlet 14 of the sluice feeder 3 (not shown).

In order to avoid unnecessary repitition the system and the method will be described simultaneously.

Steam and fibres are fed through an inlet 6 in the centrifugal separator 1, whereafter steam is recycled through a steam outlet 7 and the fibres fall out at a fibre outlet 8 and through a duct 9 to an inlet 10 of the sluice feeder 3.

As shown in FIGS. 2 and 3, the sluice feeder further comprises, besides the inlet 10, a rotor 11, provided with a number of pockets 12 for receiving fibers from the fiber separations step, a delimiting periphery wall 13 and an outlet 14. The rotor 11 is rotatably arranged in the housing 4, and, a rotational shaft 15 protrudes through the housing 4 at least on one of its sides. The shaft 15 is connected to an engine 16 for rotation of the rotor 11.

The sluice feeder 3 is attached at the housing 4 by means of attachment portions 17, for example at the inlet 10 and preferably also at the outlet 14. In the housing an inlet 18 for compressed pressure medium, for example air, and an outlet 19 for fibres and the compressed pressure medium are present. In the outlet 19 form the housing 4 a control valve 20 is arranged by which the pressure in the housing 4 may be regulated.

The fibres fall out from the sluice feeder 3 at the sluice feeder outlet 14 to the lower portion of the housing 4 and are brought by means of the pressure medium throught the outlet 19 of the housing 4 via the control valve 20 and further to a drying duct 2. In the drying duct 2 hot air flows which simultaneously both dries and transports the fibres.

At the compression of the pressure medium in the compressor 5 the temperature of the pressure medium rises and instead of cooling the heat off, which is customary, the temperature rise is utilized in the following drying step, i.e. the energy used for compressing the pressure medium is transferred into heat energy in the pressure medium which subsequently is utilized for drying the fibres.

A first sensor 21 is provided for sensing the pressure before and in the sluice feeder 3, for example in the duct 9 or at the inlet 10 to the sluice feeder, and a second sensor 22 is provided to sense the pressure in the housing 4. A control means 23 is provided in the system which compare the pressure in and before the sluice feeder 3 and the pressure in the housing 4 and which subsequently controls the control valve 20 depending on the result of the comparison.

The invention claimed is:

1. A system for feeding fibers from a steam separator at a first pressure to a dryer at a second, lower pressure, the system comprising:

a sluice feeder provided between the steam separator and the dryer through which the fibers are fed from the steam separator toward the dryer, said sluice feeder including an inlet for receiving fibers from the steam separator and at least one outlet, said at least one outlet being enclosed by a housing having an outlet through which fibers are fed from said sluice feeder to the dryer;

a pressurization means for pressurizing an interior of said housing; and a control means for controlling said pressurization means to regulate pressure in said housing;

wherein said control means controls said pressurization means to create a third pressure in said housing to prevent steam from passing through said sluice feeder toward the dryer.

2. The system according to claim 1, wherein said sluice feeder is substantially enclosed by said housing.

3. The system according to claim 1, wherein said pressurization means includes a compressor for supplying said housing with a compressed pressure medium and the compressed pressure medium is used to convey the fibers through said outlet of said housing toward the dryer.

4. The system according to claim 3, wherein said compressor creates a temperature rise in the pressure medium by compressing the pressure medium, and wherein the temperature rise is used to dry the fibers being conveyed.

5. The system according to claim 1, wherein said dryer is a drying device that uses hot air to dry the fibers that are fed from said outlet in said housing by means of pressure medium generated by said pressurization means.

6. The system according to claim 1 wherein, said steam separator is a centrifugal separator that separates some steam from the fibers before the fibers are fed to said sluice feeder.

7. The system according to claim 6, wherein said centrifugal separator includes means for steam recycling.

8. The system according to claim 1, wherein said sluice feeder further includes a rotor rotatably arranged in said housing.

9. The system according to claim 8, wherein said rotor is rotatable by an engine outside said housing.

10. The system according to claim 1, further comprising a first sensor for sensing a pressure in said inlet of said sluice feeder and a second sensor for sensing a pressure in said housing, and said first and second sensors being connected to said control means.

11. The system according to claim 10, further comprising a control valve for controlling flow of the fibers from said outlet of said sluice feeder toward the dryer and said control means controlling said control valve based on result a comparison of pressures sensed by said first and second sensors.

12. A method for feeding fibers from a steam separator at a first pressure to a dryer at a second, lower pressure, the method comprising:

providing a sluice feeder between the steam separator and the dryer, said sluice feeder including an inlet for receiving fibers from the steam separator and at least one outlet, said at least one outlet being enclosed in a housing;

passing the fibers from the steam separator to said inlet of said sluice feeder and conveying the fibers from said inlet of said sluice feeder into said housing;

pressurizing an interior of the housing;

feeding the fibers from said housing to the dryer; and regulating the pressure in said housing to create a third pressure in said housing to permit the fibers to be conveyed out of said housing to the dryer without allowing steam to escape from said sluice feeder toward the dryer.

13. The method according to claim 12, including enclosing the sluice feeder by the housing.

14. The method according to claim 13, including increasing a temperature of the pressure medium to dry the fibers within the housing.

15. The method according to claim 12, further utilizing a compressor to supply the housing with a pressurized medium.

16. A system for feeding fibers that have been treated with steam, comprising:

a steam separator at a first pressure;

a dryer at a second, lower pressure;

a sluice feeder provided between said steam separator and said dryer, said sluice feeder including an inlet for receiving fibers from said steam separator and at least one outlet, said at least one outlet being enclosed by a housing;

a pressurization means for pressurizing said housing; and a control means for controlling said pressurization means to regulate pressure in said housing;

wherein said control means controls the pressurization means to create a third pressure in said housing to permit the fibers to be conveyed to said dryer without allowing the steam to escape from said steam separator through said sluice feeder and toward said dryer.

17. The system of claim 16 wherein said pressurization means generates a pressurized medium for conveying fibers from an outlet of said housing toward said dryer.

18. The system of claim 17 including an outlet valve for controlling flow of fibers from said outlet of said housing.

19. The system of claim 18 including sensors for sensing pressure adjacent said inlet of said sluice feeder and pressure within said housing and said control means using sensed pressures to control the third pressure within said housing.

* * * * *